US010093102B2

(12) United States Patent
Kimura

(10) Patent No.: US 10,093,102 B2
(45) Date of Patent: Oct. 9, 2018

(54) LIQUID EJECTING HEAD AND LIQUID EJECTING APPARATUS

(71) Applicant: SEIKO EPSON CORPORATION, Tokyo (JP)

(72) Inventor: Sho Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/668,950

(22) Filed: Aug. 4, 2017

(65) Prior Publication Data

US 2018/0086084 A1 Mar. 29, 2018

(30) Foreign Application Priority Data

Sep. 26, 2016 (JP) ..... 2016-186609

(51) Int. Cl.
*B41J 2/045* (2006.01)
*B41J 2/175* (2006.01)
*B41J 2/14* (2006.01)

(52) U.S. Cl.
CPC ..... *B41J 2/175* (2013.01); *B41J 2/04531* (2013.01); *B41J 2/14145* (2013.01); *B41J 2/14153* (2013.01); *B41J 2/14233* (2013.01); *B41J 2002/14241* (2013.01); *B41J 2002/14306* (2013.01); *B41J 2002/14419* (2013.01); *B41J 2202/08* (2013.01)

(58) Field of Classification Search
CPC .... B41J 2/175; B41J 2/04531; B41J 2/14153; B41J 2/14145; B41J 2002/14306; B41J 2/14233; B41J 2202/08; B41J 2002/14419; B41J 2002/14241
See application file for complete search history.

(56) References Cited

U.S. PATENT DOCUMENTS

2005/0052485 A1* 3/2005 Komatsu ..... B41J 29/38 347/17
2013/0194352 A1* 8/2013 Watanabe ..... B41J 2/14233 347/71

FOREIGN PATENT DOCUMENTS

JP 2013-154485 A 8/2013

* cited by examiner

*Primary Examiner* — Yaovi M Ameh
(74) *Attorney, Agent, or Firm* — Workman Nydegger

(57) ABSTRACT

A liquid ejecting head includes a nozzle that ejects a liquid, a flow path member formed with a flow path that guides the liquid to the nozzle, a supply path member formed with a supply path that supplies the liquid to the flow path member, and a heater that heats the supply path member. A linear expansion coefficient of the supply path member is greater than a linear expansion coefficient of the flow path member. The flow path member and the supply path member are joined together by a thermoset adhesive. The heater is provided to the supply path member.

6 Claims, 5 Drawing Sheets

LIQUID EJECTING HEAD AND LIQUID EJECTING APPARATUS

BACKGROUND

1. Technical Field

The present invention relates to a liquid ejecting head and a liquid ejecting apparatus.

2. Related Art

An ink jet printer is one example of a liquid ejecting apparatus known to date. Generally, in an ink jet printer, a printing medium such as paper is printed on by ejecting ink, this being one example of a liquid, from a liquid ejecting head toward the printing medium. Hitherto, a configuration in which a communication substrate made from a silicon substrate and a case head made of synthetic resin are adhesively joined has been known for such liquid ejecting heads (for example, see JP-A-2013-154485).

The communication substrate and the case head are heated in cases in which a thermoset adhesive is employed to adhere the communication substrate and the case head to each other. When this is performed, the communication substrate and the case head are adhered to each other in a state in which the thermal expansion of the case head configured from synthetic resin is greater than the thermal expansion of the communication substrate configured from silicon. When the communication substrate and the case head return to room temperature, the contraction of the case head is greater than the contraction of the communication substrate. Accordingly, residual stress arises between the communication substrate and the case head. Such residual stress is a factor that reduces the reliability of the liquid ejecting head. Namely, it has been difficult to improve the reliability of existing liquid ejecting heads.

SUMMARY

The invention may be implemented by the following aspects and application examples.

Application Example 1

A liquid ejecting head according to the present application example includes a nozzle that ejects a liquid, a flow path member formed with a flow path that guides the liquid to the nozzle, a supply path member formed with a supply path that supplies the liquid to the flow path member, and a heater that heats the supply path member. A linear expansion coefficient of the supply path member is greater than a linear expansion coefficient of the flow path member. The flow path member and the supply path member are joined together by a thermoset adhesive. The heater is provided to the supply path member.

In this liquid ejecting head, heating the supply path member using the heater enables the supply path member to be expanded. Residual stress arising due to a difference in the amounts of contraction of the flow path member and the supply path member after the thermoset adhesive has set can thereby be reduced. This enables the reliability of the liquid ejecting head to be easily improved.

Application Example 2

Preferably, the liquid ejecting head further includes a temperature sensor that measures the temperature of the supply path member, and a control section that controls driving of the heater based on a measurement result from the temperature sensor. It is also preferable that the temperature sensor is provided to the supply path member.

In this liquid ejecting head, driving of the heater can be controlled based on a result of measuring the temperature of the supply path member with the temperature sensor, thereby enabling the temperature of the supply path member to be easily held constant. Thus, since it is easier to hold the supply path member at a constant amount of expansion, fluctuations in the stress arising between the flow path member and the supply path member can be easily suppressed.

Application Example 3

It is preferable that the supply path member is configured from a synthetic resin and that the flow path member is configured from an inorganic material.

In this liquid ejecting head, the linear expansion coefficient of the supply path member configured from synthetic resin is greater than a linear expansion coefficient of the flow path member configured from an inorganic material. This configuration enables residual stress between the flow path member and the supply path member to be reduced. This liquid ejecting head enables the degree of freedom for material selection for the supply path member to be increased, thereby enabling the cost for the liquid ejecting head to be easily reduced.

Application Example 4

A liquid ejecting apparatus according to the present application example includes one of the liquid ejecting heads described above.

In the liquid ejecting head of this liquid ejecting apparatus, the supply path member can be expanded by heating the supply path member using the heater. This enables residual stress arising due to a difference in the amounts of contraction of the flow path member and the supply path member after the thermoset adhesive has set to be reduced. This enables the reliability of the liquid ejecting head to be easily improved, thereby enabling the reliability of the liquid ejecting apparatus to be easily improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Explanation follows regarding an embodiment of the invention, with reference to the drawings. Note that in each of the following drawings, in order for the various layers and various members to be large enough to be discerned, the various layers and various members are not shown to scale.

Figure 1:
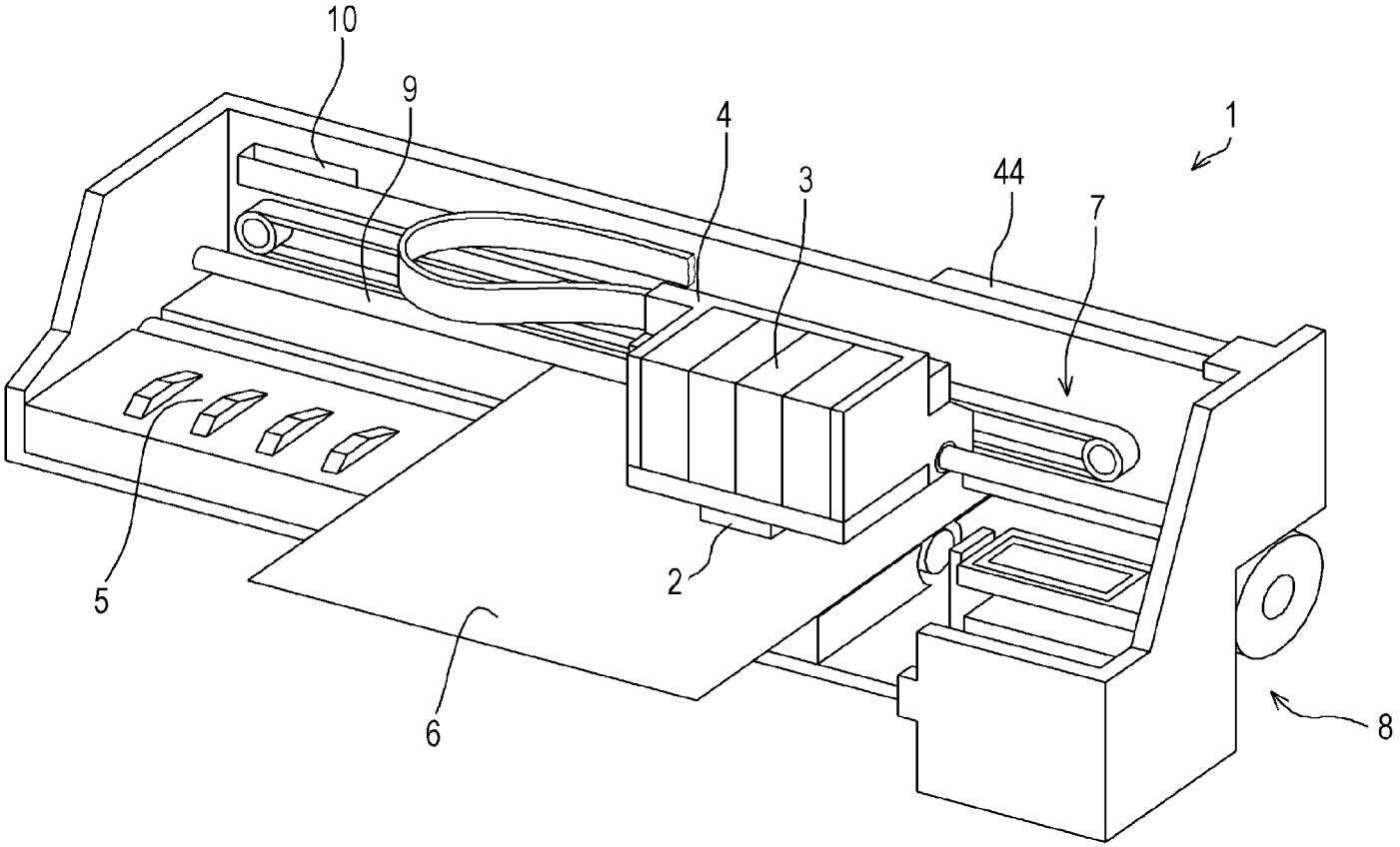
FIG. 1 is a schematic diagram of an ink jet recording apparatus according to an embodiment.

The ink jet recording apparatus 1 (simply referred to as printer 1 hereafter) illustrated in FIG. 1 is an example of a liquid ejecting apparatus.

The printer 1 includes an ink jet recording head unit 2 (simply referred to as head unit 2 hereafter), this being a type of liquid ejecting head. The head unit 2 is able to discharge ink, this being an example of a liquid, as ink droplets. The printer 1 includes a carriage 4 upon which the head unit 2 and an ink cartridge 3 are loaded, a platen 5 arranged below the head unit 2, a carriage moving mechanism 7 that moves the carriage 4 along the paper width direction of recording paper 6, a paper feed mechanism 8 that transports the recording paper 6 along a paper feed direction, this being a direction orthogonal to the paper width direction. Herein, the paper width direction is a primary scanning direction (the direction along which the head unit 2 moves to and fro), and the paper feed direction is a secondary scanning direction (namely, a direction orthogonal to the primary scanning direction of the head unit 2).

The carriage 4 is attached in a state axially supported by a guide rod 9 spanning the primary scanning direction, and is configured so as to move along the guide rod 9 in the primary scanning direction by operation of the carriage moving mechanism 7. The primary scanning direction position of the carriage 4 is detected using a linear encoder 10, and a detection signal, serving as position information, is transmitted to a control section 44. Accordingly, the control section 44 is able to control a recording operation (ejecting operation) or the like in which ink droplets are discharged from the head unit 2 while recognizing the scanning position of the carriage 4 (head unit 2) based on the position information from the linear encoder 10. The control section 44 controls the driving of the configuration described above and governs the recording operation of the printer 1.

Note that although an ink jet recording head was given as an example of a liquid ejecting head in the embodiment described above, recently, liquid ejecting heads are also being practically applied to various manufacturing apparatuses that utilize their ability to accurately land minute amounts of ink at specific positions. For example, liquid ejecting heads have practical applications in display manufacturing apparatuses that manufacture color filters for liquid crystal displays or the like; electrode forming apparatuses that form electrodes for organic electroluminescent (EL) displays, field emission displays (FEDs), and the like; and chip manufacturing apparatuses that manufacture biochips (biochemical elements). A recording head for an image recording apparatus ejects liquid ink, and colorant ejecting heads for a display manufacturing apparatus eject respective solutions of red (R), green (G), and blue (B) colorants. An electrode material ejecting head for an electrode forming apparatus ejects liquid electrode material, and a bioorganic material ejecting head for a chip manufacturing apparatus ejects a solution of bioorganic material.

Figure 2:
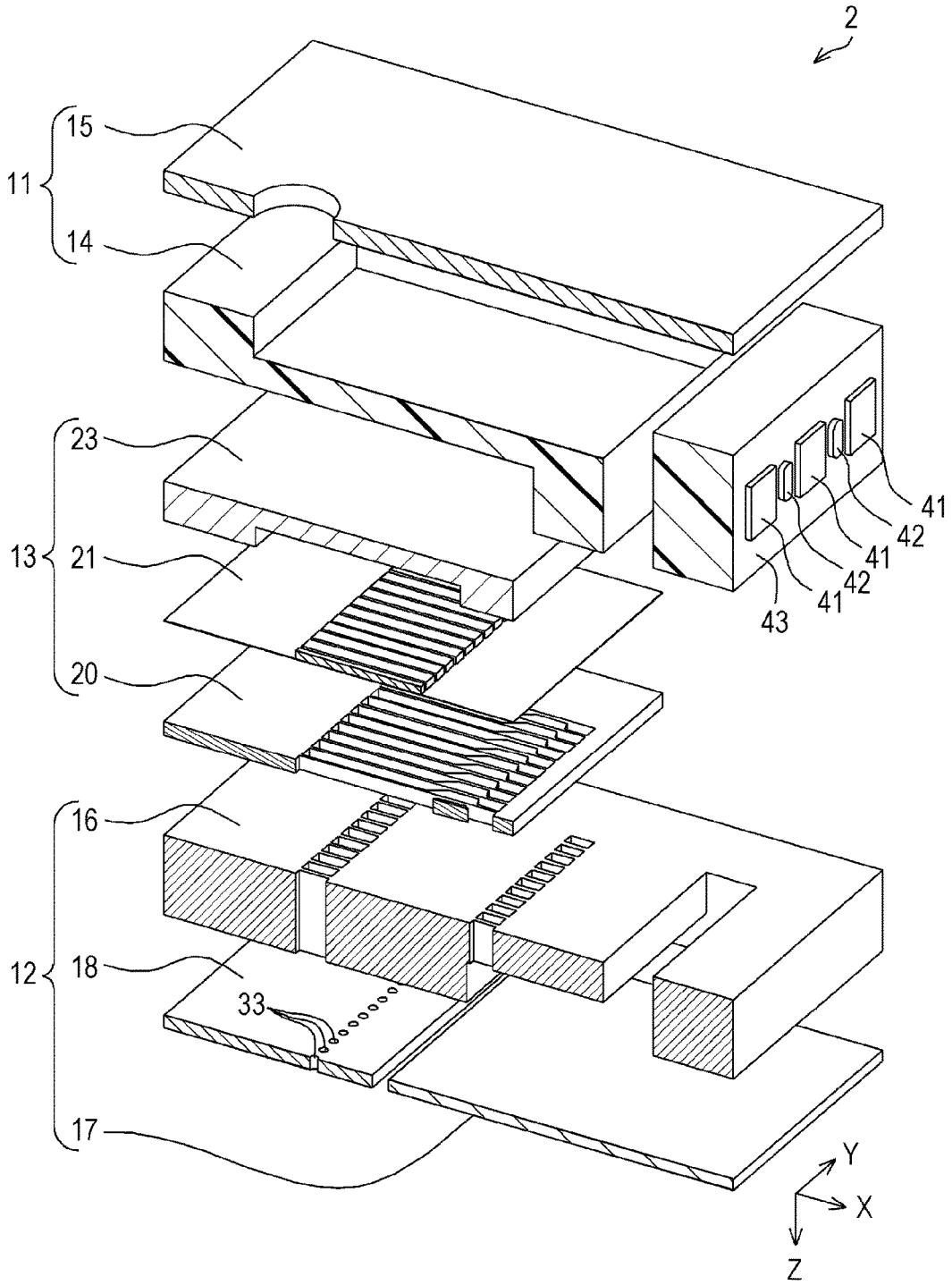
FIG. 2 is an exploded perspective view illustrating configuration of a head unit according to an embodiment.

FIG. 2 is an exploded perspective view illustrating configuration of the head unit 2. The head unit 2 of the present embodiment includes an upper flow path unit 11, a lower flow path unit 12, and a pressure generation unit 13. The head unit 2 is configured in a state in which these members are stacked together. A case substrate 14 and an upper sealing substrate 15 are stacked together to configure the upper flow path unit 11. The lower flow path unit 12 includes a communication substrate 16, a lower sealing substrate 17, and a nozzle substrate 18. A pressure chamber formation substrate 20 formed with pressure chambers 19, an elastic film 21, piezoelectric elements 22, and a protective substrate 23 are stacked together as a unit to configure the pressure generation unit 13. As a result of the above configuration, the head unit 2 has a configuration in which plural substrates are stacked together. The plural substrates include the nozzle substrate 18, the communication substrate 16, the pressure chamber formation substrate 20, the protective substrate 23, the case substrate 14, and the upper sealing substrate 15. Note that plural nozzles 32 are formed in the nozzle substrate 18. Heaters 41 and temperature sensors 42, described below, are also provided at an outer peripheral portion 43 of the case substrate 14.

Herein, an extension direction of a nozzle row in which the plural nozzles 32 are arranged is the Y direction, a direction in which the plural substrates are stacked (referred to as the stacking direction hereafter) is the Z direction, and the direction orthogonal to both the Y direction and the Z direction is the X direction. The X direction corresponds to a first direction, the Z direction corresponds to a second direction, and the Y direction corresponds to a third direction. Note that in each of the drawings, the arrows point along + (positive) directions, and directions opposite to the directions the arrows point are − (negative) directions.

Figure 3:
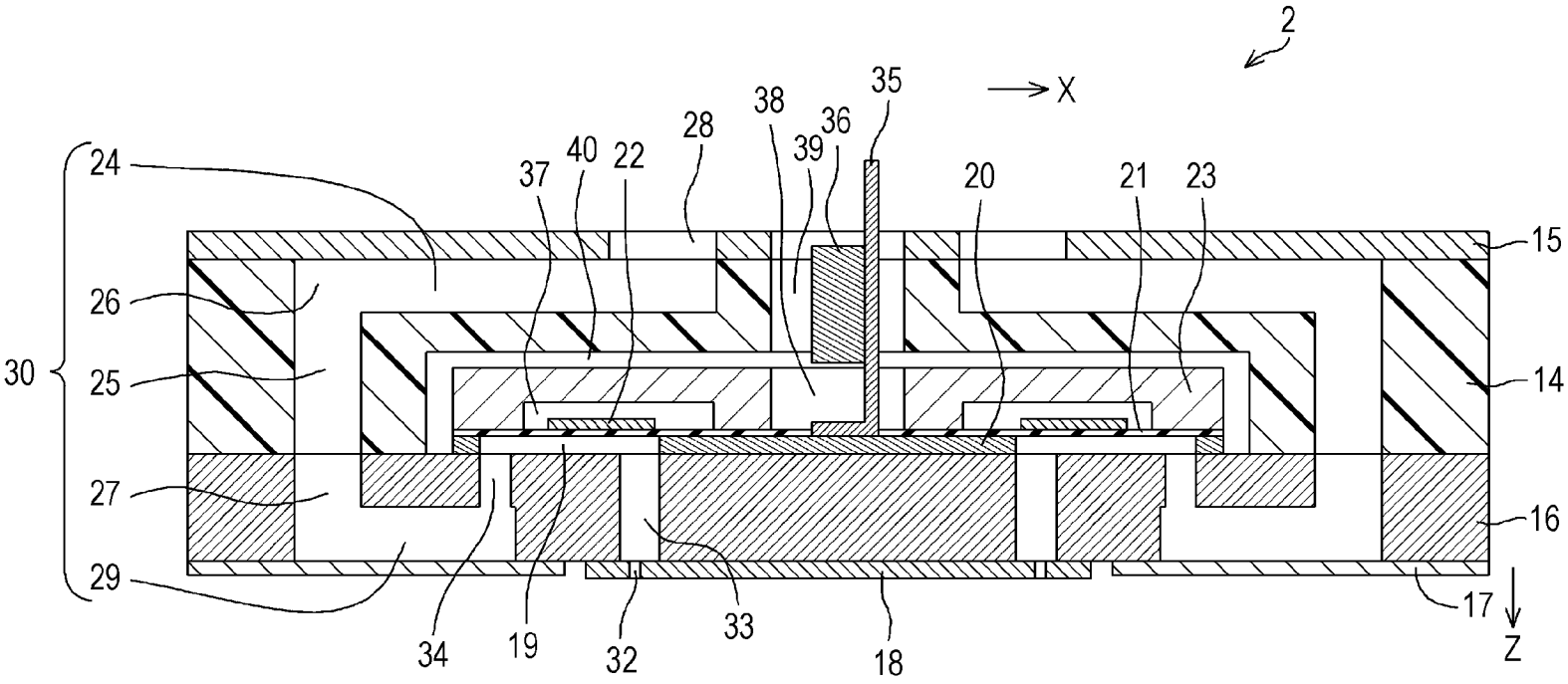
FIG. 3 is a cross-section illustrating configuration of a head unit according to an embodiment.

FIG. 3 is a cross-section illustrating configuration of the head unit 2. As illustrated in FIG. 3, a first flow path 24 and a second flow path 25 are formed in the case substrate 14, which is a configuration member of the upper flow path unit 11. The first flow path 24 and the second flow path 25 intersect at a bend portion 26. The first flow path 24 extends along the X direction. The second flow path 25 extends along a direction having a stacking direction component that intersects the X direction. Namely, the flow path from the first flow path 24 to the second flow path 25 includes the first flow path 24 extending along the X direction, the bend portion 26 that bends toward a direction having a stacking direction component that intersects the X direction, and the second flow path 25 that extends from the bend portion 26 and that has a stacking direction component intersecting the X direction. In the present embodiment, the direction having a stacking direction component intersecting the X direction is the Z direction. Namely, in the present embodiment, the second flow path 25 extends along the Z direction.

The first flow path 24 and the second flow path 25 form the bend portion 26 and are connected through the bend portion 26. As illustrated in FIG. 3, the second flow path 25 is connected to a penetrating flow path 27, described below, thereby connecting the first flow path 24 and the penetrating flow path 27. The case substrate 14 is made from a material that can be easily molded, for example, a synthetic resin. For example, a modified polyphenylene ether resin or the like may be employed as the synthetic resin. In the present embodiment, the case substrate 14 is formed by injecting the synthetic resin into a mold.

As illustrated in FIG. 3, the second flow path 25 extends from the upper sealing substrate 15 side toward the lower sealing substrate 17 side. The first flow path 24 and the penetrating flow path 27 are linked along the stacking direction (Z direction), this having the shortest distance therebetween, thereby enabling the flow path to be configured by a short route. Thus, ink is able to flow through the shortest route, enabling bubbles in the flow path to be discharged in a short amount of time.

The upper sealing substrate 15 is joined to the side of a face of the case substrate 14 in which the first flow path 24 is opened. This opening is sealed off by the upper sealing substrate 15. The upper sealing substrate 15 is provided with an ink inlet path 28 that penetrates the upper sealing substrate 15 in the substrate thickness direction (Z direction). Ink from the ink cartridge 3 (FIG. 1) is introduced into the head unit 2 through the ink inlet path 28. Ink that has been introduced through the ink inlet path 28 passes through the first flow path 24, the bend portion 26, and the second flow path 25, and is supplied to the part of a common liquid chamber 30 made up of the penetrating flow path 27 and a common communication path 29, described below. Namely, the case substrate 14 and the upper sealing substrate 15 configure a supply path that supplies ink from the ink cartridge 3 to the lower flow path unit 12. Namely, the upper flow path unit 11 is formed with a supply path that supplies ink to the lower flow path unit 12. Ink that has been supplied to the common liquid chamber 30 in the lower flow path unit 12 is discharged from the nozzles 32 as ink droplets onto the recording paper 6. Namely, the nozzles 32 are portions that eject liquid.

As illustrated in FIG. 2, the outer peripheral portion 43 of the case substrate 14 is the face that, of the surfaces of the case substrate 14, faces the positive X axis direction. The outer peripheral portion 43 of the case substrate 14 faces the direction intersecting the direction that the case substrate 14 and the upper sealing substrate 15 are stacked. Namely, in the head unit 2, the outer peripheral portion 43 of the case substrate 14 is not overlaid onto any of the components configuring the upper flow path unit 11, lower flow path unit 12, or the pressure generation unit 13. Accordingly, the outer peripheral portion 43 of the case substrate 14 can be seen from the outside of the head unit 2 when the upper flow path unit 11, the lower flow path unit 12, and the pressure generation unit 13 have been stacked.

The heaters 41 are heating devices, the driving of which is controlled by the control section 44, described below. Heat generated by the heaters 41 is conducted from the outer peripheral portion 43 to the inside of the case substrate 14. The case substrate 14 is thereby heated. Namely, the heaters 41 heat the case substrate 14. Ceramic heaters or the like may be employed as the heaters 41. The temperature sensors 42 are devices that measure the temperature of an object. The temperature sensors 42 measure the temperature of the outer peripheral portion 43 of the case substrate 14. Measured temperature information is transmitted to the control section 44. A configuration including thermocouples, thermistors, or the like may be employed as the temperature sensors 42.

The pressure chamber formation substrate 20, which is a configuration member of the pressure generation unit 13 illustrated in FIG. 2, is made from a monocrystalline silicon substrate (simply referred to as a silicon substrate hereafter). A monocrystalline silicon substrate is a type of crystalline substrate. An anisotropic etching process is performed on a silicon substrate to form plural of the pressure chambers 19 in the pressure chamber formation substrate 20 in correspondence with respective nozzles 32, described below, in the nozzle substrate 18. Forming the pressure chambers 19 by anisotropically etching a silicon substrate enables more precise dimensions and shapes to be secured. In the present embodiment, two rows of the nozzles 32 are formed in the nozzle substrate 18 (FIG. 3). Accordingly, two rows of the pressure chambers 19 are formed in the pressure chamber formation substrate 20 so as to correspond to the nozzle rows. The pressure chambers 19 are cavities that are elongated in the X direction of the nozzles 32.

As illustrated in FIG. 3, when the pressure chamber formation substrate 20 (pressure generation unit 13) is joined to the communication substrate 16 in a state after having been positioned with respect to the communication substrate 16, one X direction end portion of each pressure chamber 19 is placed in communication with a respective nozzle 32 through a nozzle communication path 33 in the communication substrate 16, described below. The other X direction end portion of each pressure chamber 19 is placed in communication with the common liquid chamber 30 (common communication path 29) through an individual supply-side communication path 34 in the communication substrate 16. As a result of the above configuration, an ink flow path from the ink inlet path 28 to the nozzles 32 is configured by the common liquid chamber 30, which includes the first flow path 24 and the second flow path 25, the individual supply-side communication paths 34, the pressure chambers 19, and the nozzle communication paths 33.

The communication substrate 16, which is a configuration member of the lower flow path unit 12, is made from an inorganic material. In the present embodiment, the communication substrate 16 is configured from silicon. Silicon is an example of an inorganic material. The communication substrate 16 is formed from a silicon substrate. The penetrating flow path 27, which is part of the common liquid chamber 30, is formed in the communication substrate 16 in a state penetrating the communication substrate 16 along its plate thickness direction using anisotropic etching. The individual supply-side communication paths 34 and the nozzle communication paths 33 are provided at positions corresponding to the pressure chambers 19, at positions to the central side of the substrate with respect to the penetrating flow path 27. Both the individual supply-side communication paths 34 and the nozzle communication paths 33 are penetrated through the communication substrate 16 along its plate thickness direction using anisotropic etching. The common communication path 29 is formed straddling the individual supply-side communication paths 34 and the penetrating flow path 27 using half-etching, thereby placing the penetrating flow path 27 and the individual supply-side communication paths 34 in communication with each other. The opening of the common communication path 29 and the penetrating flow path 27 is sealed off by the lower sealing substrate 17. Note that since the joining portion between the communication substrate 16 and the nozzle substrate 18, described below, is at the substrate central side of the opening of the common communication path 29 and the penetrating flow path 27, the opening is not covered by the nozzle substrate 18.

The nozzle substrate 18, which is a configuration member of the lower flow path unit 12 illustrated in FIG. 2, is a member in which plural of the nozzles 32 are linearly laid out at a pitch corresponding to a dot formation density when printing. In the present embodiment, two nozzle rows are formed in the nozzle substrate 18 (FIG. 3). The nozzle substrate 18 is configured by a silicon substrate, and cylindrically shaped nozzles 32 are formed using dry etching. In a positioned state, the nozzle substrate 18 is joined to the side of a face of the communication substrate 16 having an opening, thus placing the nozzles 32 and the pressure chambers 19 in communication with each other through the nozzle communication paths 33. Namely, the pressure chamber formation substrate 20 (pressure generation unit 13), the communication substrate 16, the lower sealing substrate 17, and the nozzle substrate 18 form an ink flow path from the common communication path 29 to the nozzles 32.

As illustrated in FIG. 3, an elastic film 21 is formed on an upper face of the pressure chamber formation substrate 20 (the face on the opposite side to the communication substrate 16 joining face) in a state sealing off upper openings of the pressure chambers 19. The elastic film 21 is, for example, configured from silicon dioxide approximately 1 μm thick. A non-illustrated insulating film is formed over the elastic film 21. The insulating film is, for example, composed of zirconium oxide. The piezoelectric elements 22 are formed over the elastic film 21 and the insulating film at positions respectively corresponding to the pressure chambers 19. The piezoelectric elements 22 are what are known as flexural mode piezoelectric elements. The piezoelectric elements 22 are configured by sequentially stacking a lower electrode film made of metal, a piezoelectric body layer composed of lead zirconate titanate (PZT) or the like, and an upper electrode film made of metal (none of which are illustrated in the drawings) on the elastic film 21 and the insulating film, and then patterning each of the pressure chambers 19. One of the upper electrode film or the lower electrode film is configured as a common electrode, and the other of the upper electrode film or the lower electrode film is configured into individual electrodes. The elastic film 21, the insulating film, and the lower electrode film function as a diaphragm when the piezoelectric elements 22 are driven.

A non-illustrated electrode wiring portion respectively extends out over the insulating film from the individual electrode (upper electrode film) of each piezoelectric element 22. A terminal on one end side of a flexible cable 35 is connected to a portion corresponding to an electrode terminal of these electrode wiring portions. The flexible cable 35 has, for example, a configuration in which a conductor pattern, using a layer of copper or the like, is formed on the surface of a base film such as polyimide, and the conductor pattern is covered by a resist. A driving IC 36 that drives the piezoelectric elements 22 is mounted on the surface of the flexible cable 35. The piezoelectric elements 22 undergo flexural deformation when a drive signal (drive voltage) is applied across the upper electrode film and the lower electrode film through the driving IC 36.

As illustrated in FIG. 3, the protective substrate 23 is disposed over the upper face of the pressure chamber formation substrate 20 where the piezoelectric elements 22 and the elastic film 21 are formed. The protective substrate 23 is a hollow box shaped member, of which a lower face side is open. The protective substrate 23 is, for example, made from glass, a ceramic material, a monocrystalline silicon substrate, metal, a synthetic resin, or the like. An escape recess 37, of a size such that a region thereof opposing the piezoelectric elements 22 does not obstruct driving of the piezoelectric elements 22, is formed in the protective substrate 23. In addition, a wiring cavity 38 is formed in the protective substrate 23 between the adjacent rows of the piezoelectric elements. The wiring cavity 38 penetrates the protective substrate 23 along its substrate thickness direction. The electrode terminals of the piezoelectric elements 22 and the one end portion of the flexible cable 35 are disposed in the wiring cavity 38.

At a central portion in a plan view of the upper flow path unit 11, a penetrating cavity 39 (FIG. 3) having an opening that is elongated along the Y direction (FIG. 2), this being the array direction of the nozzles 32, is formed in a state penetrating each of the case substrate 14 and the upper sealing substrate 15 along their thickness direction. As illustrated in FIG. 3, the penetrating cavity 39 is in communication with the wiring cavity 38 of the pressure generation unit 13, thus forming a cavity in which the driving IC 36 and the one end portion of the flexible cable 35 are housed. A housing cavity 40 recessed from a lower face of the upper flow path unit 11 to partway along the height direction of the case substrate 14 is formed at a lower face side of the upper flow path unit 11. The depth of the housing cavity 40 is set slightly larger than the thickness (height) of the pressure generation unit 13. The dimensions of the housing cavity 40 are set slightly larger than the dimensions of the external profile of the pressure generation unit 13. When the lower flow path unit 12 is joined to the lower face of the upper flow path unit 11 in a state after having been positioned with respect thereto, the pressure generation unit 13 stacked on the communication substrate 16 is housed in the housing cavity 40. A lower end of the penetrating cavity 39 opens to a top face of the housing cavity 40.

When manufacturing the head unit 2 configured as described above, first, the elastic film 21 and the insulating film are sequentially formed on an upper face of the pressure chamber formation substrate 20 (a silicon substrate in a state having no pressure chambers 19 formed therein), after which the piezoelectric elements 22 are formed on the upper face of the pressure chamber formation substrate 20 by baking. The protective substrate 23 is joined thereto in a state in which the piezoelectric elements 22 are housed in the escape recess 37. In this state, the lower face side of the pressure chamber formation substrate 20 is anisotropically etched to form the pressure chambers 19. By thus stacking the piezoelectric elements 22 and the protective substrate 23 on the upper face side of the pressure chamber formation substrate 20 so as to form the pressure generation unit 13 into a unit at a stage prior to when the pressure chambers 19 are formed in the pressure chamber formation substrate 20, damage to the pressure chamber formation substrate 20 during the assembly process of the pressure generation unit 13 can be suppressed.

Next, in a state in which the nozzle communication path 33 and the nozzles 32 are in communication with each other, the nozzle substrate 18 is adhesively joined to the lower face of the communication substrate 16. Then, in a state in which opening of the penetrating flow path 27 and the common communication path 29 is blocked off, the lower sealing substrate 17 is joined to the lower face of the communication substrate 16. The lower flow path unit 12 is thereby formed into a unit. Then, the case substrate 14 is joined to the upper sealing substrate 15 using adhesive. Thereby, the first flow path 24 is sealed off and the ink inlet path 28 formed in the upper sealing substrate 15 is placed in communication with the first flow path 24. Then, the heaters 41 and the temperature sensors 42 are joined to the outer peripheral portion 43 of the case substrate 14 using adhesive.

After each unit is complete, the pressure generation unit 13 is joined to the upper face of the communication substrate 16 of the lower flow path unit 12. Specifically, in a state in which the one X direction end portions of the pressure chambers 19 are in communication with respective nozzle communication paths 33, and in which the other X direction end portions of the pressure chambers 19 are in communication with respective individual supply-side communication paths 34, the pressure chamber formation substrate 20 of the pressure generation unit 13 is joined to the upper face of the communication substrate 16 using adhesive.

Provided that the lower flow path unit 12 and the pressure generation unit 13 are attached to one another, the flexible cable 35 can be wired to the electrode terminal of each piezoelectric element 22 through the wiring cavity 38 in the protective substrate 23. Namely, each of the terminals on the one end portion of the flexible cable 35 are electrically connected to a portion corresponding to a respective electrode terminal of the piezoelectric elements 22.

Then, the communication substrate 16 of the lower flow path unit 12 and the case substrate 14 of the upper flow path unit 11 are joined using adhesive. A thermoset adhesive may be employed to adhere the communication substrate 16 and the case substrate 14 to each other. A thermoset adhesive is an adhesive made from a resin that contains a setting agent. The setting agent in the adhesive is activated using heat, thus causing the adhesive to set. An epoxy-resin-based adhesive, for example, may be employed as the thermoset adhesive. When the communication substrate 16 and the case substrate 14 are joined, first, the thermoset adhesive is applied to an adhering face in a room temperature environment. Then, the components are heated and adhered together in a state in which the temperature of the components and the adhesive has been increased, and the components are left in a high temperature environment (hereafter referred to as a setting temperature) so as to cause the adhesive on the adhering face to set. After the adhesive has completely set, heating of the components stops and the temperature of the components returns to room temperature, thus completing the joining. When the lower flow path unit 12 and the upper flow path unit 11 are joined together, the pressure generation unit 13 is housed in the housing cavity 40, and the second flow path 25 and penetrating flow path 27 are in communication with each other. The common liquid chamber 30 composed of the first flow path 24, the bend portion 26, the second flow path 25, the penetrating flow path 27, and the common communication path 29 is thereby formed. In addition, the driving IC 36 and the one end portion of the flexible cable 35 are housed inside the penetrating cavity 39 of the upper flow path unit 11. This completes the head unit 2.

Then, the series of common flow paths including the ink inlet path 28 and the common liquid chamber 30 from the first flow path 24 to the common communication path 29; and the individual flow paths from the individual supply-side communication paths 34, through the pressure chambers 19 and the nozzle communication paths 33, and to the nozzles 32 are formed in the head unit 2.

When joining the case substrate 14 and the communication substrate 16, the case substrate 14, the communication substrate 16, and the adhesive are left in a high temperature environment (for example, approximately 80° C.). This causes the adhesive between the case substrate 14 and the communication substrate 16 to set. When this occurs, due to being left in the high temperature environment, the case substrate 14 and the communication substrate 16 reach high temperatures, and the volumes of the case substrate 14 and the communication substrate 16 undergo thermal expansion. After the adhesive has set, the case substrate 14, the communication substrate 16, and the adhesive are returned to room temperature (for example, approximately 25° C.). Due to the temperature decrease when this occurs, the case substrate 14 and the communication substrate 16 attempt to return to their pre-thermal-expansion volumes. Namely, the temperature change causes the case substrate 14 and the communication substrate 16 to contract. Namely, the adhesive sets in a state in which the case substrate 14 and the communication substrate 16 have undergone thermal expansion, and after the adhesive has set, the case substrate 14 and the communication substrate 16 contract. The linear expansion coefficient of synthetic resin is greater than that of inorganic material. Thus, the linear expansion coefficient of the case substrate 14 made of synthetic resin is greater than that of the communication substrate 16 made of inorganic material. Accordingly, deformation due to expansion or contraction arising as a result of change in temperature at the time of joining is greater in the case substrate 14 than in the communication substrate 16. The difference in deformation causes residual stress to arise between the case substrate 14 and the communication substrate 16. Such residual stress is not desirable in terms of the reliability of the head unit 2.

Figure 4:
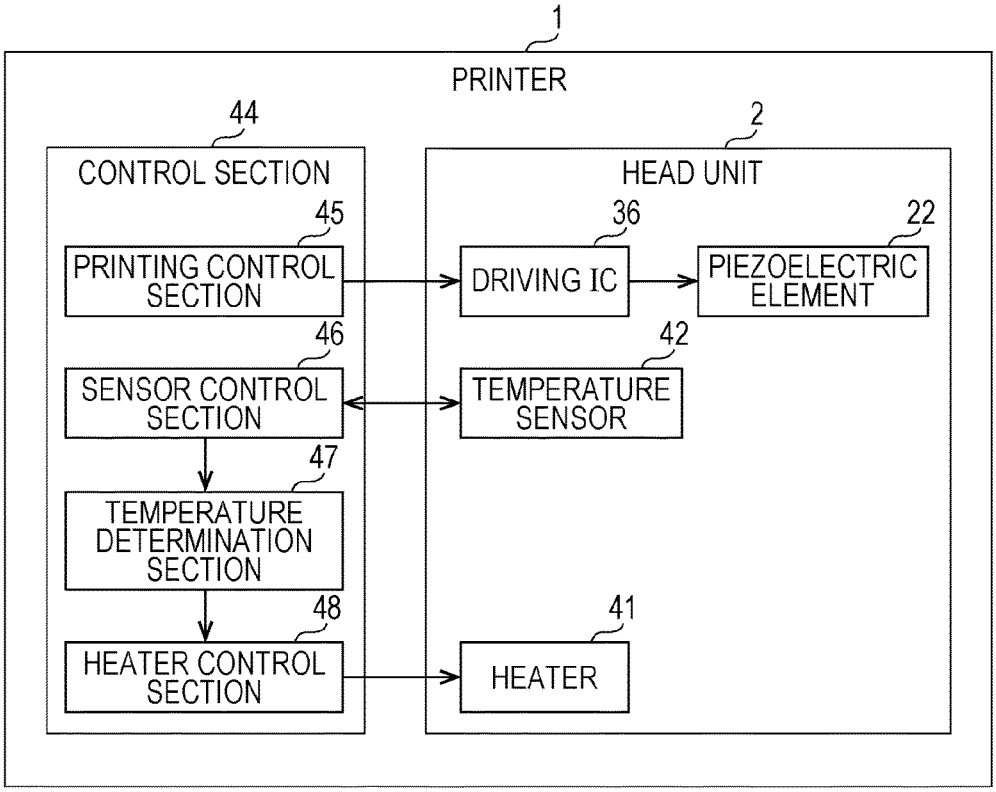
FIG. 4 is a block diagram illustrating control configuration of a head unit according to an embodiment.

FIG. 4 is a block diagram illustrating control configuration of the printer 1. The control section 44 includes a printing control section 45, a sensor control section 46, a temperature determination section 47, and a heater control section 48. The control section 44 may be configured as a circuit substrate that includes a CPU, RAM, ROM, and the like, not illustrated in the drawings. The head unit 2 also includes the driving IC 36 described above. The driving IC 36 controls driving of the piezoelectric elements 22. The printing control section 45 controls the driving IC 36 to drive the piezoelectric elements 22, thereby controlling the discharge of ink from the head unit 2.

The sensor control section 46 instructs the temperature sensors 42 to perform a temperature measurement, causes a signal relating to the measured temperature (referred to as a temperature signal) to be output therefrom, and acquires the temperature signal. The acquired temperature signal is converted into temperature data indicating the temperature of the case substrate 14, and the temperature data is output to the temperature determination section 47. A permissible temperature range is set in the temperature determination section 47. The temperature determination section 47 determines whether the acquired temperature data is inside the permissible range or outside the permissible range, and outputs an instruction to the heater control section 48 based on the determination result.

At this time, when the temperature determination section 47 has determined that the temperature data falls below a lower limit of the permissible range, the temperature determination section 47 instructs the heater control section 48 to drive (turn ON) the heaters 41. When the temperature determination section 47 has determined that the temperature data exceeds an upper limit of the permissible range, the temperature determination section 47 instructs the heater control section 48 to stop (turn OFF) the heaters 41. The heater control section 48 controls driving of the heaters 41 based on the instruction from the temperature determination section 47. Such control suppresses temperature fluctuation of the case substrate 14 and enables the temperature of the case substrate 14 to be easily kept to a constant range.

Note that in the present embodiment, the CPU executes a program to implement each of the functional sections of the control section 44 through software. However, each of the functional sections of the control section 44 may, for example, be implemented by hardware such as an integrated circuit or may be implemented by software and hardware acting in concert.

The following advantageous effects are able to be obtained with the head unit 2 according to the present embodiment as described above. Explanation follows regarding the advantageous effects of the heaters 41 and the temperature sensors 42, with reference to FIG. 2 and FIG. 3. As illustrated in FIG. 3, the case substrate 14 and the communication substrate 16 are joined using a thermoset adhesive so as to configure the common liquid chamber 30. In order to cause the adhesive to set, the case substrate 14 and the communication substrate 16 are adhered to each other in a thermally expanded state in a high temperature environment. Accordingly, the case substrate 14 and the communication substrate 16 undergo contraction deformation when they are returned to a room temperature environment. The synthetic resin employed in the case substrate 14 has a higher linear expansion coefficient than the inorganic material employed in the communication substrate 16. Thus, the amount of contraction deformation undergone by the case substrate 14 when returned to a room temperature environment is greater than that of the communication substrate 16. This difference in contraction deformation causes residual stress to arise between the case substrate 14 and the communication substrate 16. Such residual stress is not desirable in terms of the reliability of the head unit 2.

Regarding this issue, in the present embodiment, as illustrated in FIG. 2, the heaters 41 are installed on the outer peripheral portion 43 of the case substrate 14. The temperature of the case substrate 14 is increased by driving the heaters 41 to heat the case substrate 14 through the outer peripheral portion 43. A temperature difference from the temperature of the case substrate 14 when the thermoset adhesive sets is thereby reduced. Reducing the temperature difference enables the amount of contraction deformation undergone by the case substrate 14 to be reduced and enables the difference in the amount of contraction deformation arising between the case substrate 14 and the communication substrate 16 to be reduced. Namely, heating the case substrate 14 with the heaters 41 enables the case substrate 14 to be expanded. Residual stress arising due to the difference in the amounts of contraction of the case substrate 14 and the communication substrate 16 after the thermoset adhesive has set can thereby be reduced. This enables the reliability of the head unit 2 to be easily improved.

It is preferable that the temperature of the case substrate 14 after being heated by the heaters 41 is lower than the setting temperature of the thermoset adhesive for adhering the case substrate 14 and the communication substrate 16 to each other, and that the temperature difference between the temperature of the case substrate 14 after being heated by the heaters 41 and the setting temperature of the thermoset adhesive does not exceed 5° C. Namely, in the present embodiment, it is preferable that the temperature of the case substrate 14 after having been heated is at least 75° C. but less than 80° C. This temperature range is an ideal temperature range for the case substrate 14. Stress acting against the residual stress between the communication substrate 16 and the case substrate 14 is liable to arise when the temperature of the case substrate 14 exceeds the ideal temperature range, and so this is undesirable. However, it is difficult to cause sufficient thermal expansion of the case substrate 14 when the temperature of the case substrate 14 falls below the ideal temperature range, and so this too is undesirable. In the present embodiment, the linear expansion coefficient of the synthetic resin is approximately ten to twenty times greater than the linear expansion coefficient of the inorganic material. Thus, to have the amount of contraction deformation of the synthetic resin be around the amount of contraction deformation of the inorganic material, the difference between the setting temperature of the thermoset adhesive and the temperature of the synthetic resin needs to be around one twentieth to one tenth of the difference between the setting temperature and the temperature of the inorganic material. Note that in a room temperature environment, the difference between the temperature of the communication substrate 16 employing inorganic material and the setting temperature of the thermoset adhesive is approximately 50° C. Accordingly, if the difference in the temperature of the case substrate 14 made of synthetic resin and the setting temperature of the thermoset adhesive can be maintained within approximately 5° C. using the heaters 41, the amounts of contraction deformation of the communication substrate 16 and the case substrate 14 can be made to approximate each other. Namely, if the temperature of the case substrate 14 is within the ideal temperature range, residual stress between the communication substrate 16 and the case substrate 14 can be effectively reduced.

In order to maintain the temperature of the case substrate 14 within the ideal temperature range, the permissible temperature range set in the temperature determination section 47 is preferably a range having a temperature difference of from 1° C. to 4° C. from the thermoset adhesive setting temperature, this being the temperature at which the thermoset adhesive sets. Namely, in the present embodiment, it is preferable that the permissible temperature range set in the temperature determination section 47 be from 76° C. to 79° C. With this permissible range, for example, the heaters 41 will be stopped (turned OFF) when the temperature of the case substrate 14 reaches 79° C. Thus, the temperature of the case substrate 14 is not liable to exceed 80° C. Moreover, for example, the heaters 41 will be driven (turned ON) when the temperature of the case substrate 14 reaches 76° C. Thus, the temperature of the case substrate 14 is not liable to fall below 75° C. Thus, by setting the above temperature range in the temperature determination section 47, it is easier to contain the temperature of the case substrate 14 within the ideal temperature range.

The present embodiment enables the difference in the amounts of deformation arising between the case substrate 14 and the communication substrate 16 to be reduced, thus improving the dimensional precision of the components configuring the head unit 2 and suppressing deformation such as the flexure of components arising in accordance with differences in amounts of deformation. This enables, for example, the positional accuracy of the nozzles 32 and the directional accuracy of the nozzles 32 to be easily improved. The positional and directional accuracy of liquid ejected from the nozzles 32 can thereby be easily increased and the landing position accuracy of the liquid on the recording paper 6 can be easily improved, enabling the quality of images made on the recording paper 6 to be improved and the printing performance of the printer 1 to be increased.

Note that in the present embodiment, the communication substrate 16 corresponds to a flow path member, and the case substrate 14 corresponds to a supply path member.

However, the invention is not limited to the exemplary embodiment described above; various modifications thereto are possible. Explanation follows regarding a modified example.

Modified Example 1

Figure 5:
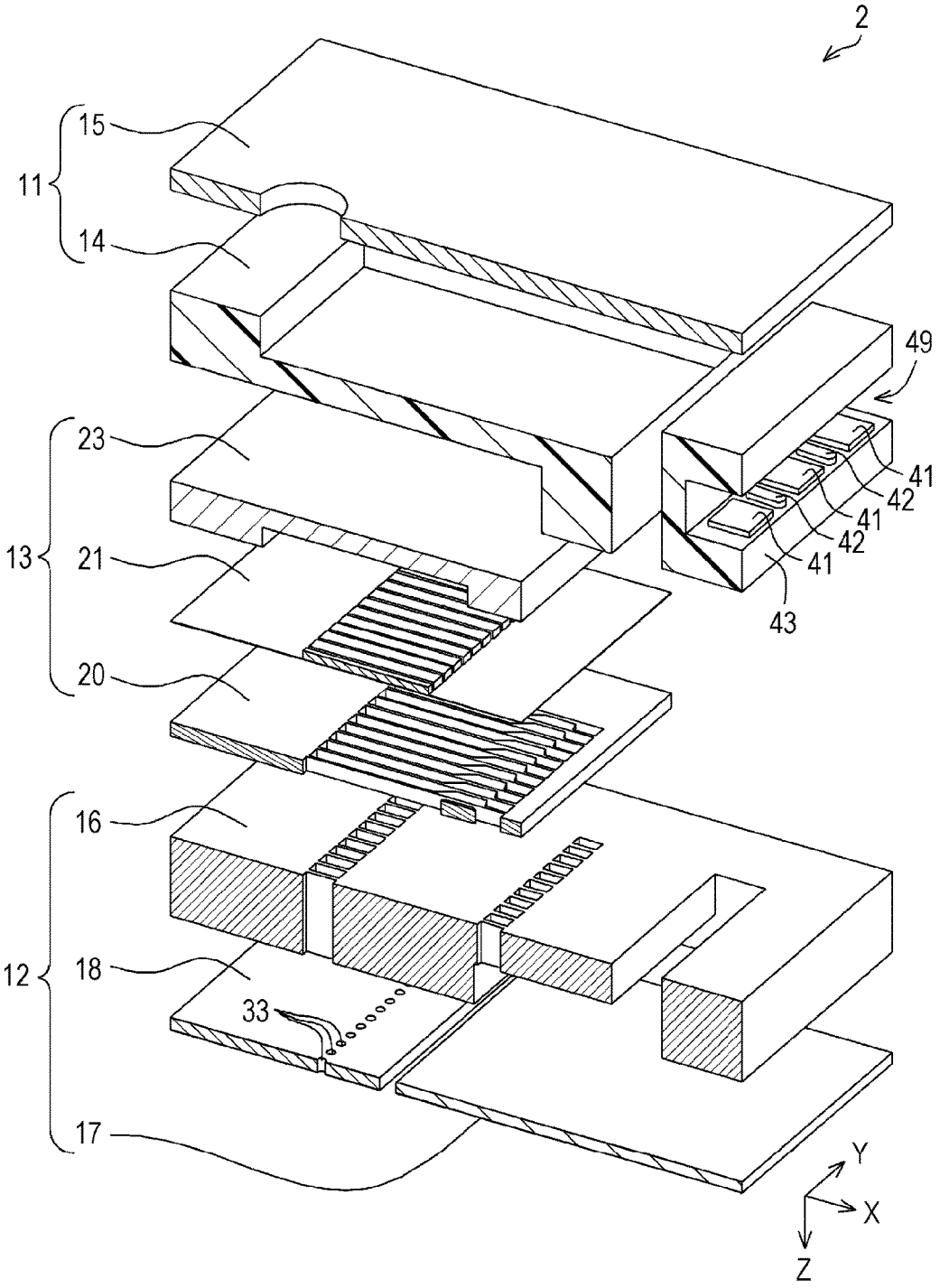
FIG. 5 is an exploded perspective view illustrating configuration of a head unit according to a first modified example.

In the above embodiment, the heaters 41 and the temperature sensors 42 are provided on the outer peripheral portion 43 of the case substrate 14. However, there is no limitation to the location where the heaters 41 and the temperature sensors 42 are provided. A configuration may be adopted in which the heaters 41 and the temperature sensors 42 are provided inside the case substrate 14. For example, as illustrated in FIG. 5, a configuration may be adopted in which a groove 49 is formed sunk in toward the negative X direction from the outer peripheral portion 43 of the case substrate 14, and the heaters 41 and the temperature sensors 42 are stored in the groove 49. With this configuration, the heaters 41 and the temperature sensors 42 are provided inside the case substrate 14.

In the first modified example, since the position heated by the heaters 41 is near the boundary plane between the case substrate 14 and the communication substrate 16, the time for heat conduction from the heaters 41 to the case substrate

14 near the boundary plane can be shortened. In addition, the temperature measured by the temperature sensors 42 is a temperature of the case substrate 14 able to be measured at a position closer to the boundary plane, thereby enabling errors in the measured temperature to be reduced. Accordingly, the accuracy of the temperature of the case substrate 14 can be easily increased, enabling fluctuations in the residual stress between the communication substrate 16 and the case substrate 14 to be lessened. Moreover, the heaters 41 and the temperature sensors 42 are stored inside the case substrate 14, thereby enabling the head unit 2 to be easily reduced in size. Thus, for example, it is easier to ensure the space that is necessary during assembly with other components.

The entire disclosure of Japanese Patent Application No. 2016-186609, filed Sep. 26, 2016 is expressly incorporated by reference herein.

What is claimed is:

1. A liquid ejecting head comprising:

a nozzle that ejects a liquid;

a flow path member formed with a flow path that guides the liquid to the nozzle;

a sealing substrate;

a supply path member formed with a supply path that supplies the liquid to the flow path member, the supply path provided between the flow path member and the sealing substrate; and the supply path member having an outer peripheral portion;

a heater being provided on the outer peripheral portion, and between the flow path member and the sealing substrate;

a linear expansion coefficient of the supply path member being greater than a linear expansion coefficient of the flow path member;

the flow path member and the supply path member being joined together by a thermoset adhesive;

the heater heating the supply path member so that a temperature of the supply path member is within a first predetermined temperature range; and the heater heating the thermoset adhesive via the supply path member so that a temperature of the thermoset adhesive is within a second predetermined temperature range.

2. The liquid ejecting head according to claim 1, further comprising:

a temperature sensor that measures the temperature of the supply path member; and a control section that controls driving of the heater based on a measurement result from the temperature sensor;

the temperature sensor being provided to the supply path member.

3. The liquid ejecting head according to claim 1, wherein:

the supply path member is configured from a synthetic resin; and the flow path member is configured from an inorganic material.

4. A liquid ejecting apparatus comprising:

the liquid ejecting head according to claim 1.

5. A liquid ejecting apparatus comprising:

the liquid ejecting head according to claim 2.

6. A liquid ejecting apparatus comprising:

the liquid ejecting head according to claim 3.

* * * * *